US005832822A

United States Patent [19]

Hamu

[11] Patent Number: 5,832,822

[45] Date of Patent: Nov. 10, 1998

[54] SYSTEM FOR REGISTRATION OF WORK SUPPORT PALLETS WITH SCREEN FRAMES OF CAROUSEL PRINTING MACHINE

[76] Inventor: Kaino J. Hamu, 16061 Dominica Cir., Huntington Beach, Calif. 92649

[21] Appl. No.: 957,961

[22] Filed: Oct. 21, 1997

[51] Int. Cl.[6] ..... B41F 15/16

[52] U.S. Cl. ..... 101/126; 101/127.1; 101/DIG. 36; 101/486

[58] Field of Search ..... 101/114, 115, 101/126, 123, 124, 129, 127.1, DIG. 36, 485, 486; 33/614, 615, 617, 620

[56] References Cited

U.S. PATENT DOCUMENTS 4,669,378 6/1987 Lee .
5,226,362 7/1993 Iaccino et al. .
5,503,068 4/1996 Newman ..... 101/126
5,613,436 3/1997 Taylor ..... 101/115
5,664,495 9/1997 Winter ..... 101/126
5,694,845 12/1997 Newman ..... 101/126

*Primary Examiner*—Ren Yan
*Attorney, Agent, or Firm*—Boniard I. Brown

[57] ABSTRACT

A detachably mounted pallet tool is utilized on the arms of a carousel printing machine and work support pallets thereon to provide a more efficient and rapid registration with stationary screen frames associated with the machine, without removal of work support pallets from the arms. A bracket on an arm and cooperating fitting on the pallet tool provide for quick, detachable mounting and removal of the pallet tool.

15 Claims, 4 Drawing Sheets

SYSTEM FOR REGISTRATION OF WORK SUPPORT PALLETS WITH SCREEN FRAMES OF CAROUSEL PRINTING MACHINE

BACKGROUND AND SUMMARY OF THE INVENTION

The present invention is utilized with carousel printing machines wherein work support pallets are mounted on respective arms extending outwardly from and rotatable by the machine. The work pallets, each on a separate arm, are moved to register each pallet with successive stationary print stations spaced about a circumference centered on the axis of the machine. Carousel printing machines are illustrated and described in the application of Alan Hamu, Ser. No. 08/539,050, U.S. Pat. No. 4,669,378 to Lee, and U.S. Pat. No. 5,226,362 to Iaccino et al., and the machine is not herein described in detail.

Generally, a carousel screen printer machine comprises a plurality of print stations for stationary screen frames spaced circumferentially about a machine axis, and means for rotating respective of the arms, with work pallet thereon, into the positions under successive screen frames for the printing of a sequence of accurately registered images, typically in different colors. The accurate registration of successive images printed on a workpiece, is important.

Prior art arrangements have required the removal and later re-mounting of work support pallets on their machine arms, in the process of alignment of the work support pallets with screen frames of the machine. The work support pallet is removed, replaced with an alignment pallet, and then re-mounted and secured on the arm after registration with a screen frame. This procedure is a somewhat complicated process involving the time, labor and expense of the unbolting of a work support pallet from a machine arm, mounting an alignment pallet on the arm, utilizing the pallet alignment tool to provide alignment with a screen frame, then remounting and securing, as by bolts, the work support pallet on the arm.

The present invention provides the important advantages of quick, convenient installation and removal of a pallet tool relative to a support arm of a carousel printing machine, simplified alignment of a work support pallet with a pallet tool, and the disassembly of a work support pallet from the arm and reassembly thereof on the arm after registration with a screen frame.

The invention provides a pallet tool detachably mounted on an arm of a carousel printing machine to provide more efficient and faster procedure not requiring disassembly of work support pallets from the arms of the machine for registration of work support pallets with screen frames. In a preferred embodiment, the pallet tool is detachably mounted by means of a bracket on an end portion of a machine arm and a cooperating fitting on the pallet tool which have interengaging features which are quickly engageable and disengageable.

DESCRIPTION OF THE PREFERRED EMBODIMENT

Figure 1:
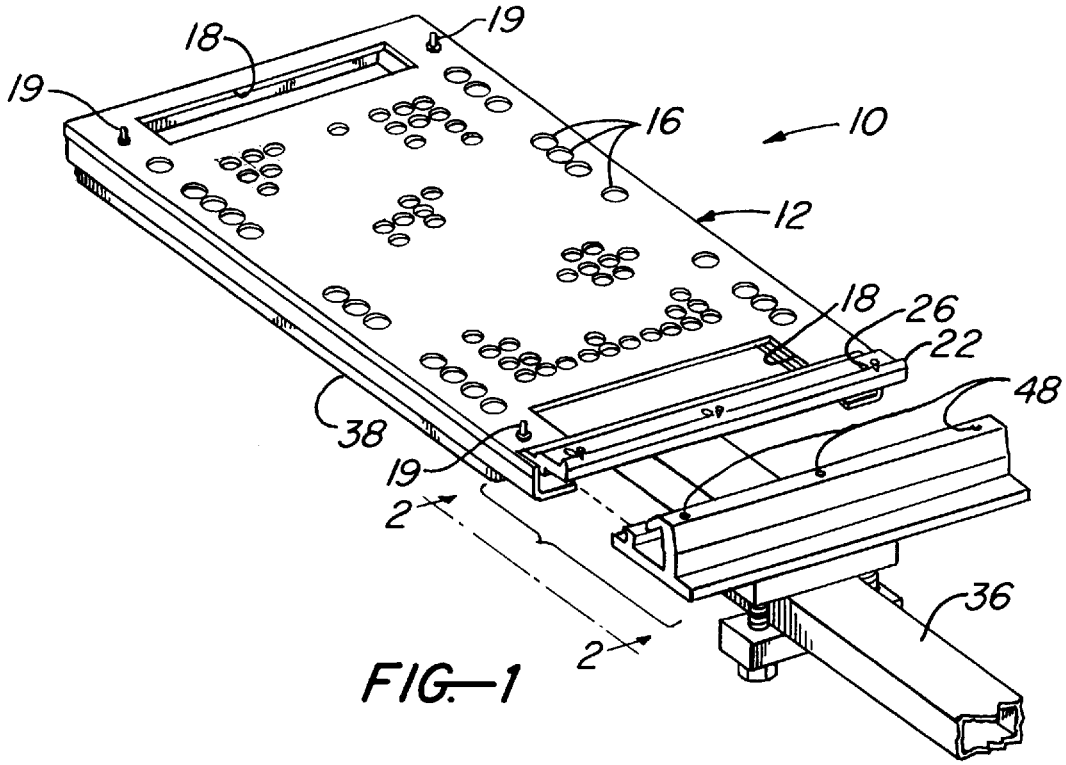
FIG. 1 is a perspective view of a work alignment tool according to the invention, and a bracket for detachably mounting the pallet tool relative to an arm of a carousel printing machine.

Referring to the drawings, and particularly FIG. 1, a pallet tool 10 according to the invention comprises a frame 12 which is similar in plan configuration to a work support pallet utilized with a carousel printing machine. The frame is of generally rectangular configuration, and has a multiplicity of openings for the purpose of reducing weight, and relatively large rectilinear openings 18 in each end portion to accommodate the extensions thereinto of screen frame clamps (hereinafter discussed). Registration pins 19 extend upwardly from three corners of the pallet tool and are preferably spring loaded bolts (not shown).

Figure 2:
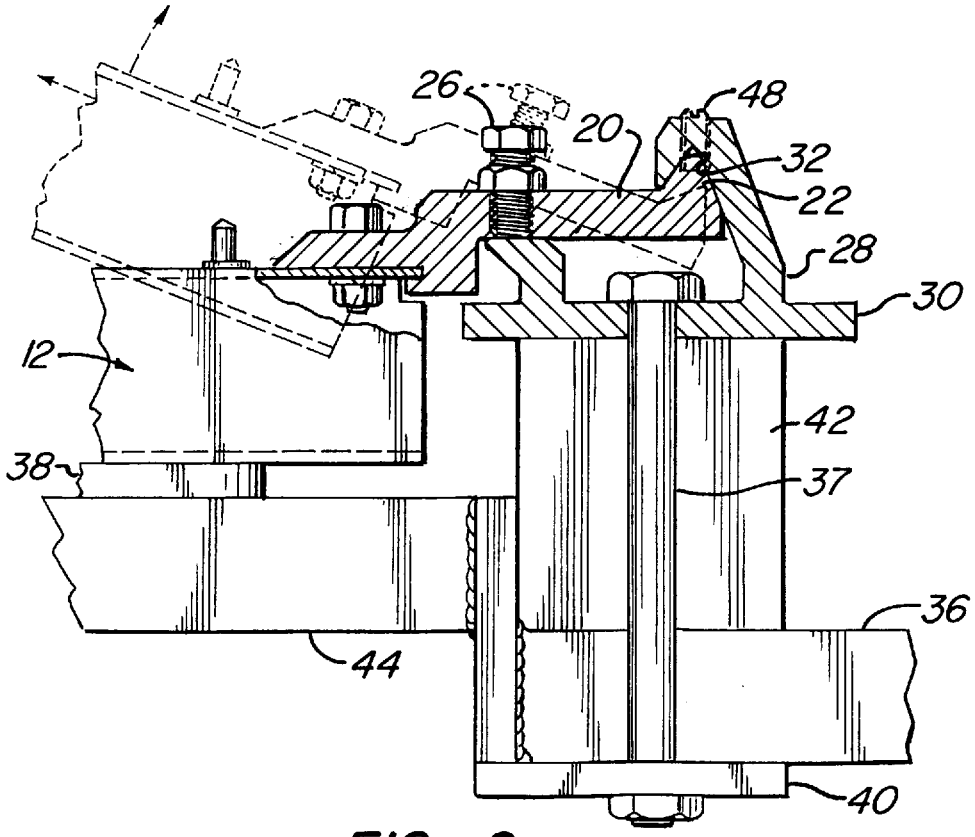
FIG. 2 is a partial view, partially in section, showing a bracket of the invention on a machine arm and detachably mounting a pallet tool on a machine arm.

A mounting fitting 20 is secured by bolts extending through openings therein and securement nuts which secure the fitting to the end portion of the pallet tool 10 (FIG. 2). The fitting extends outwardly from the pallet tool and has a wedge-shaped end portion 22. Adjustment screws 26, typically three in number, are threadedly mounted in spaced relation in openings in the fitting.

A bracket 28 has a base portion 30 and an upwardly extending portion defining a downwardly facing transverse V-shaped groove 32. The bracket is secured on the end portion of a support arm 36, which extends from the central portion of a carousel printing machine (not shown) by bolts 37 extending on both sides of the arm and through the bracket base 30 with head portions retained in openings in the bracket base, and extending through a lower mounting plate 40 to be retained by nuts, as shown.

A spacer block 42 is secured between the arm 36 and the lower surface of the bracket base portion 30 to so elevate and position the bracket as to position the pallet tool above a work support pallet 38 which is supported on an extension 44 secured, as by welding a member 42 to the end of the arm 28, and welding the extension to member 42, as shown. If necessary or appropriate, shims (not shown) may be utilized between the bracket base and the mounting block for positioning of the bracket.

Adjustment screws 26 engage the upper surface of an upwardly extending arm 46 of the bracket, so that the adjustment screws are rotatable to provide accurate adjustment of the position or height of the pallet tool 10 relative to the work support pallet 38 secured on the extension 40.

Figure 7:
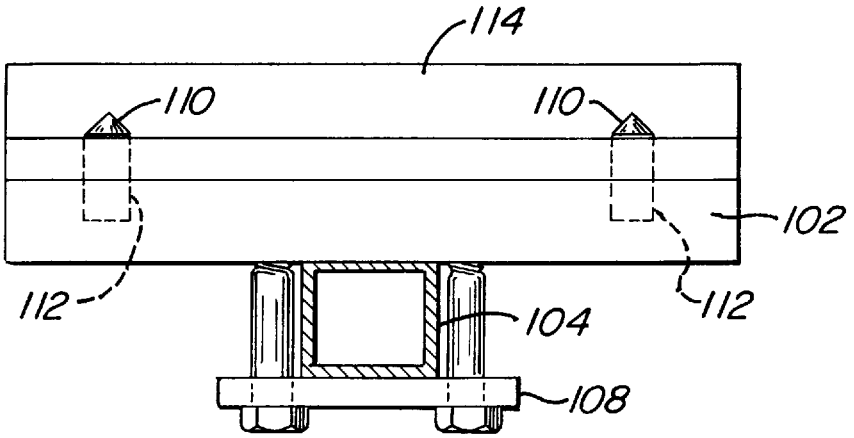
FIG. 7 is a view taken at line 7—7 in FIG. 5.

Referring to FIGS. 2 and 7, a plurality of dowel pins 48, preferably three, are closely fitted in openings defined in and extending through the bracket between its upper surface and groove 32. The dowel pins have their end portions extendable into recesses 50 accurately defined in the wedge portion 22 of fitting 20. These pins provide precise transverse positioning of the pallet tool relative to the bracket 20 and machine arm 36. Therefore, each time the pallet tool is removed from the bracket, then replaced therein, there is always accurately repositioning, as between the wedge portion of the fitting and the bracket groove.

The pallet tool is quickly insertable into engagement with the groove 32 of bracket 28 by tilting and urging inwardly the pallet tool, as indicated in phantom outline in FIG. 2. The pallet tool is readily removable by tilting the pallet tool to disengage the wedge portion of fitting 20 from the groove 32, as by tilting the pallet tool and pulling it outwardly.

Figure 4:
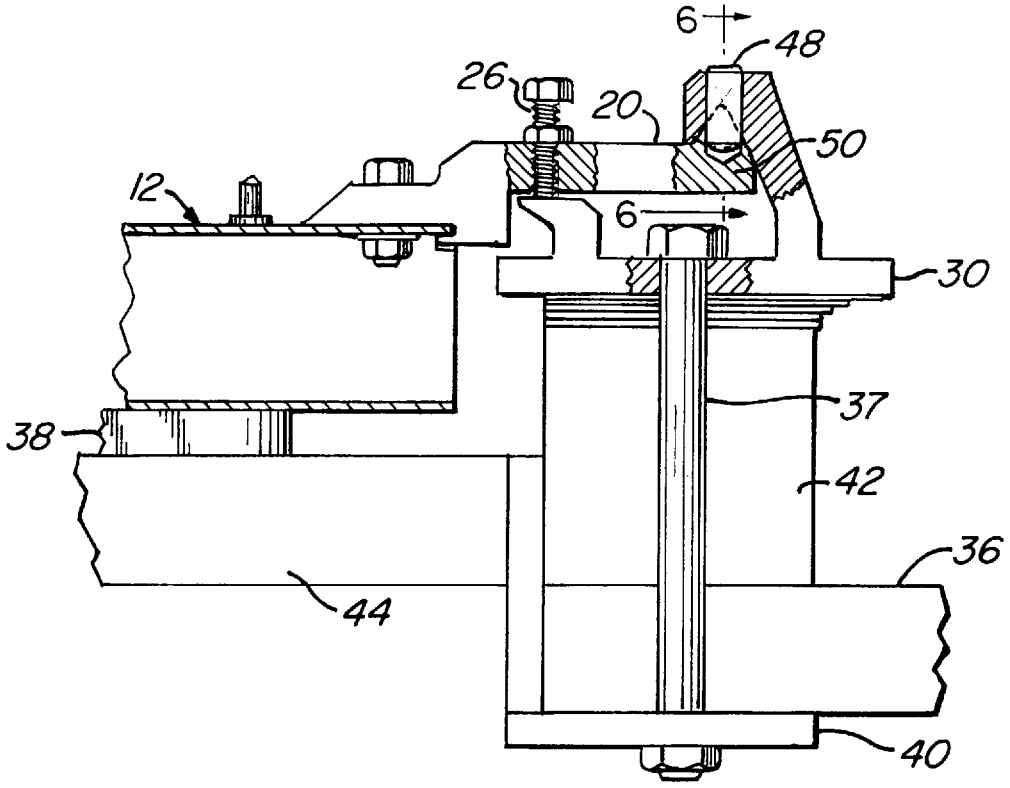
FIG. 4 is a partial view showing a pallet tool positioned on a work support pallet on the machine arm.

The pallet tool is temporarily installed on the bracket 28 during the procedure of registering a work support pallet 38 (FIGS. 2 and 4) relative to a stationary screen frame, and the pallet tool is thereafter removed from the bracket.

The pallet tool is positioned above the work support pallet 38 on the arm extension 44, accurate height adjustment of the pallet tool being provided by adjustment of the adjustment screws 26, and transverse positioning of the pallet tool being provided by the engagement of the dowel pins 48 in the recesses 22 of the wedge portion of fitting 20.

The work support pallet is then aligned or registered with the pallet tool by aligning a transverse edge of the work support pallet with a corresponding edge of the pallet tool, and aligning a longitudinal edge of the work support pallet with a corresponding edge of the pallet tool. The work support pallet is then secured in position by conventional securement means (not shown).

With the work support pallet aligned with the machine arm 36 and with the pallet tool, the work support pallet thus aligned is used for registration of screen frames, as hereinafter described.

The support bracket 28 is mounted on the bracket radially inwardly of the work support pallet, and not outwardly as in prior art arrangements. It therefore involves less time and effort to handle, engage and adjust equipment and components.

It will be understood that other forms and variations of receivers may be utilized in place of the bracket 28 and fitting 20, and may differ in structural details from the presently described embodiment.

Figure 3:
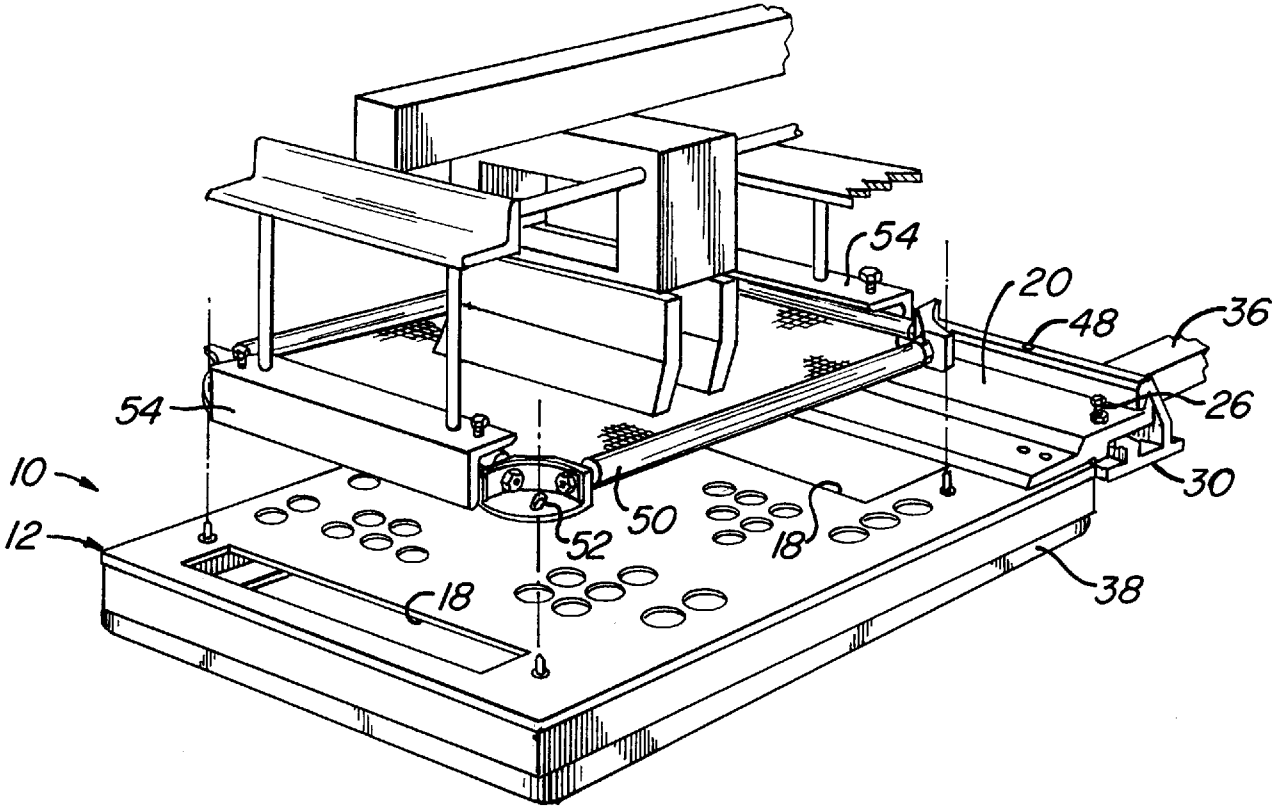
FIG. 3 is a perspective view of a pallet tool of the invention and a work support pallet under a screen frame for registration of the screen frame therewith.

To register a work support pallet with a stationary screen frame, the machine arm 36 with the pallet tool positioned as described above, and the pallet tool secured in aligned position on the arm, is moved to a position with the pallet tool disposed beneath the spaced stationary screen frame 50 (FIG. 3). The screen frame is typically mounted on a stationary arm extending from an upper portion of the printing machine central structure (not shown).

The registration pins 19 of the pallet tool are extended into corresponding registration openings 52 in corner structures of a screen frame 50 (FIG. 3) to register the pallet tool with the screen frame.

The screen frame is then clamped in registered position by means of the machine clamps 54, the clamps being accommodated by the rectilinear openings 18 in end portions of the pallet tool.

The procedure is repeated for each successive screen frame, a machine arm bearing the pallet tool thereon is removed to a successive arm for registration of successive work support pallets. At each successive screen frame station the screen frame is registered with the pallet tool so that the screen frames will all print in registration with each other on a workpiece, with successive images registering with each other.

The work support pallet maintains its predetermined position in correct alignment and registration with the screen frame. It is thus accurately registrable with each screen frame at successive stations of the printing machine, thus insuring successive registered images on each workpiece.

Figure 5:
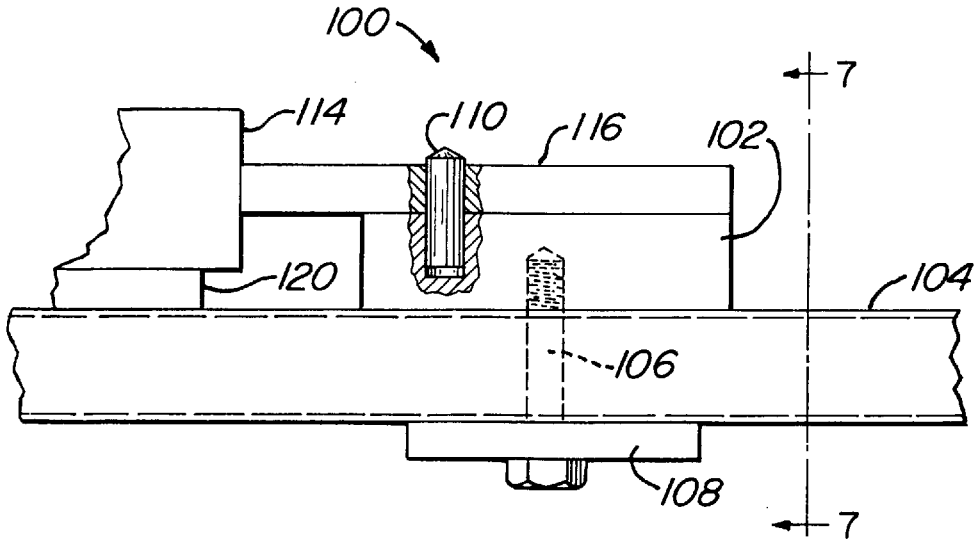
FIG. 5 is a partial view, partially in section, of a second embodiment of the invention.
Figure 6:
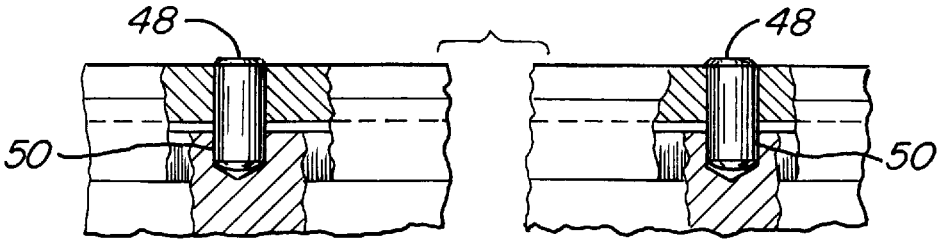
FIG. 6 is a sectional view taken at line 6—6 in FIG. 4.

FIGS. 5 and 7 illustrate a second and relatively simplified embodiment 100 of the invention, wherein a mounting block 102 is secured to a machine arm 104 by bolts 106 disposed on either side of the arm with their heads retained by a plate 108 through which the bolts extend into threaded securement in openings in the mounting block (not shown). Dowel pins 110 are closely fitted in accurately defined openings 112 in the mounting block.

A pallet tool 114 has a mounting plate 116 extending from and secured, as by welding, to its end wall. Mounting plate 116 has accurately defined therein openings for precision mounting of the pallet tool on the dowel pins 110.

With the components properly sized and configurated, and with the pin plate 116 engaged on the dowel pins 110, the pallet tool is positioned accurately above a work support pallet 120 disposed on the arm 104. The pallet tool is quickly and conveniently positionable on the dowel pins 110 to thus dispose the pallet tool accurately in proper position above the work support pallet.

The procedure in utilizing the device of FIGS. 5 and 7, is generally similar to that described relative to the embodiment of FIGS. 1–4. The work support pallet is aligned with the pallet tool and is secured in position by the dowel pins 110. The machine arm, with the work support pallet thereon, is then disposed under a screen frame, and the pallet tool registration pins are engaged in corresponding openings in the screen frame to register the pallet tool with the screen frame, which is then clamped in position. The arm and pallet tool are then moved from under the screen frame, and the pallet tool is then similarly used to register in succession other work support pallets with respective screen frames.

Thus there has been shown and described a system for registration of work support pallets with screen frames of carousel printing machines which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. Apparatus for registering a work support pallet on an arm of a carousel printing machine with a screen frame associated with the machine, comprising:

a pallet tool, means on the pallet tool and on the arm for detachably mounting the pallet tool on the arm to overlie the work support pallet thereon for aligning the work support pallet with the pallet tool and for movement of both together into proximity with the screen frame, and registration means on the pallet tool and cooperating registration means on the screen frame for registration therebetween for securement of the screen frame in its registered position.

2. Apparatus according to claim 1, and further comprising:

adjustment means cooperating with the means on the pallet tool and the means on the arm for accurately positioning the pallet tool at a height relative to the work support pallet.

3. Apparatus according to claim 1, wherein:

the registration means on the pallet tool comprise registration pins extending upwardly from at least three corners of the pallet tool, and the registration means on the screen frame comprise registration openings at at least three corners of the screen frame to receive the pins.

4. Apparatus for registering work support pallets on respective extending support arms of a carousel printing machine having associated screen frames for the imprinting of registered images on workpieces on work support pallets on respective support arms, the apparatus comprising:

a work support pallet carried by one of the arms of the machine, mounting bracket means on an end portion of the arm, a pallet tool having fitting means thereon adapted to engage the bracket means to detachably mount the pallet tool on the bracket means in a position overlying the work support pallet for alignment thereof with the pallet tool, cooperating registration means on the pallet tool and on the screen frame for registering the screen frame with the pallet tool disposed in proximity with the screen frame, and means for securing the screen frame in its registered position.

5. Apparatus according to claim 4, wherein:

the mounting bracket means defines a groove transversely of the arm, and said fitting means on the pallet tool has a wedge portion transversely of the arm and configurated to be removably engaged in said groove.

6. Apparatus according to claim 4, and further including:

a plurality of dowel pins in openings defined in the fitting means and extending into the bracket means adjacent to said groove for accurate transverse securement of the pallet tool relative to the bracket means and arm.

7. Apparatus according to claim 4, wherein:

said bracket means is secured to the arm by bolts extending through openings in the bracket means and on opposite sides of the arm and extending through a retaining plate to be secured by nuts therein.

8. Apparatus according to claim 4, and further including:

a spacer block between the machine arm and the bracket means to position the bracket means at appropriate height for positioning of the pallet tool relative to the work support pallet.

9. Apparatus according to claim 4, and further including:

adjustment means between the mounting bracket means and the pallet tool fitting means for adjustment of the pallet tool height relative to the work support pallet.

10. Apparatus according to claim 9, wherein:

said adjustment means comprises a plurality of adjustment screws threadedly mounted in the said fitting means and extending into the bracket means.

11. Apparatus according to claim 9, wherein:

said adjustment means comprises a plurality of adjustment screws threadedly mounted in said fitting means and extending into the bracket means, the bracket means defining a groove transversely of the arm, and further including a plurality of dowel pins in openings defined in the fitting means and extending into the bracket means adjacent to said groove for accurate transverse securement of the pallet tool relative to the bracket member and arm.

12. Apparatus according to claim 4, wherein:

the registration means on the pallet tool comprise registration pins extending upwardly from at least three corners of the pallet tool, and the registration means on the screen frame comprise registration openings at at least three corners of the screen frame to receive the pins.

13. A method of registering a work support pallet on a support arm of a carousel printing machine with a stationary screen frame, comprising:

providing a pallet tool having means for registration with the screen frame, detachably mounting the pallet tool on the machine arm in a position overlying the work support pallet for aligning the work support pallet with the pallet tool, positioning the pallet tool and the work support pallet in proximity with the screen frame, registering the pallet tool registration means with cooperating registration means on the screen frame, and securing the screen frame in its registration position.

14. A method of registering with stationary screen frames work support pallets on associated support arms of a carousel printing machine, comprising:

providing a pallet tool having registration means thereon for registration with one of the screen frames, detachably mounting the pallet tool on an end portion one of the arms in position to overlie the work support pallet, aligning the work support pallet with the pallet tool, positioning the pallet tool in proximity with the screen frame with the pallet tool and work support pallet on the arm, and engaging said registration means on the pallet toot with cooperating registration means on the screen frame to register the screen frame for accurate imprinting on a workpiece on the work support pallet.

15. A method according to claim 14, and further comprising:

detaching the pallet tool from the arm, and detachably mounting the pallet tool and aligning a plurality of work support pallets on respective arms therewith in succession, to register work support pallets with the screen frames for imprinting successive overlying images defined by the successive screen frames.

* * * * *